United States Patent [19]

Bhateja et al.

[11] Patent Number: 4,833,056

[45] Date of Patent: May 23, 1989

[54] MONOCOMPONENT TONER POWDER HAVING STRONG PREFERENCE FOR CHARGING POSITIVELY

[75] Inventors: Sudershan K. Bhateja, Cottage Grove; Chung I. Young, Roseville; Nancy N. Quan, Circle Pines, all of Minn.

[73] Assignee: Minnesota Mining and Manufacturing Company, St. Paul, Minn.

[21] Appl. No.: 155,034

[22] Filed: Feb. 11, 1988

[51] Int. Cl.[4] ..... G03G 9/08; G03G 9/14

[52] U.S. Cl. ..... 430/106.6; 430/110; 430/903

[58] Field of Search ..... 430/110, 903, 106.6

[56] References Cited

U.S. PATENT DOCUMENTS

| | | | |
|---|---|---|---|
| 3,816,840 | 6/1974 | Kotz | 346/74 |
| 4,189,390 | 2/1980 | Noguchi et al. | 430/111 |
| 4,224,396 | 9/1980 | Pollet | 430/107 |
| 4,230,787 | 10/1980 | Watanabe et al. | 430/107 |
| 4,291,112 | 9/1981 | Lu | 430/110 |
| 4,312,933 | 1/1982 | Lu | 430/110 X |
| 4,401,741 | 3/1983 | Miyakawa et al. | 430/110 |
| 4,430,408 | 2/1984 | Sitaramiah | 430/106.6 |
| 4,485,163 | 11/1984 | Miyakawa | 430/122 |
| 4,656,111 | 4/1987 | Wakamiya et al. | 430/110 X |
| 4,734,350 | 3/1988 | Lin et al. | 430/110 |

FOREIGN PATENT DOCUMENTS

| | | | |
|---|---|---|---|
| 59-124342 | 7/1984 | Japan | 430/110 |

OTHER PUBLICATIONS

Schaffert, R. M., "Electrophotography", Focal/Hastings House, New York, 1985.

Kotz, A. R. and Spreng, R. C., "Electronic Imaging with Monocomponent Toners", The Third Annual Guide to Ribbons and Toners38 , Datek Publishing Company, Newtonville, Mass., Jun., 1982.

*Primary Examiner*—Paul R. Michl
*Assistant Examiner*—Jeffrey A. Lindeman
*Attorney, Agent, or Firm*—Donald M. Sell; Walter N. Kirn; James V. Lilly

[57] ABSTRACT

A triboelectrically chargeable monocomponent toner powder is provided which comprises as a binder a mixture of a copolymer of styrene and an acrylate with an amine-containing aliphatic wax as a charge-control agent. The toner is inherently strongly chargeable positively through triboelectric forces.

10 Claims, 2 Drawing Sheets

MONOCOMPONENT TONER POWDER HAVING STRONG PREFERENCE FOR CHARGING POSITIVELY

FIELD OF THE INVENTION

The invention concerns monocomponent (or one-part) toner powder useful in electrophotographic copying non-impact printing processes. More particularly, it relates to dry heat-fusible and pressure-fixable toner powder made of a thermoplastic binder and magnetically responsive material such as magnetite.

DESCRIPTION OF THE RELATED ART

In electrophotographic or xerographic copying or non-impact printing processes, reversal imaging is often preferred over forward imaging for a number of reasons. For example, in forward imaging the entire background area is illuminated. This results in stripes or lines in the background and causes a great deal of scattered light which tends to make the images fuzzy. These problems are overcome through the use of reversal imaging. In this type of imaging only the characters, i.e., the light-struck, uncharged area are illuminated and toned. This is a faster and more energy-efficient imaging because the image area is generally smaller than the background or unimaged area.

Two-component toners tend to be highly effective in reversal imaging in terms of high image density and good contrast due to efficient and controlled triboelectrification (contact electrification) of the numerous, small toner particles through a large surface area of contact with the carrier particles. (See, R. M. Schaffert, "Electrophotography", Focal/Hastings House, New York, 1985 for further details on electrophtography, reversal imaging and triboelectrification).

Monocomponent toners (also referred to herein as one part toners) have not previously provided high image densities and good contrast except at low development speeds. Due to the absence of carrier particles, triboelectrification usually occurs only due to surface contact of the toner with itself or surface contact of the toner with the development roller or the doctor blade. Because of this small surface area of contact, prior monocomponent toners tend to charge primarily by the induction process, i.e., only under an applied electric field. Thus, prior monocomponent toners have been little used for reversal imaging in spite of the fact that monocomponent toner powders offer a number of important advantages over 2-component toners. Some of those advantages have been taught in A. R. Kotz and R. C. Spreng, "Electronic Imaging with Monocomponent Toners" in "The 3rd Annual Guide to Ribbons and Toners", Datek Publishing Company, Newtonville, MA June 1982 and in Wilson U.S. Pat. No. 2,846,333 which describes the use of a magnetic brush system for developing latent images that can be transferred electrostatically and fused onto plain paper. Pollet U.S. Pat. No. 4,224,396 reports that the electrical conductivity of Wilson's toner inhibited electrostatic transfer and uses a quaternary ammonium polymer as a charge control agent to provide toner powders of low resistivity. Pollet's toners may be either monocomponent or used with a carrier.

A number of other monocomponent toner powders have been patented, most of which are chemically similar to that of Pollet, e.g., being formed from a mixture of magnetically responsive material, a thermoplastic binder such as a copolymer of styrene and an acrylate or a methacrylate, plus additional material, mostly dyes which acts as a charge control agent. See, for example, Watanabe et al. U.S. Pat. No. 4,230,787 where, because the electrical conductivity of a prior toner powder had interfered with transferring it onto paper, an electric charge controlling dyestuff was incorporated into monocomponent toner powder.

Miyakawa et al. U.S. Pat. No. 4,401,741 concerns a monocomponent toner powder which incorporates both a positive charge control agent and a negative charge control agent. Doing so is said to solve problems of flowability and cohesion experienced in the use of prior toner powders.

Miyakawa U.S. Pat. No. 4,485,163 is especially concerned with image sharpness when using a monocomponent toner powder for developing positively charged images on plain paper. Miyakawa says this requires "a certain balance between the magnetic characteristic and charging characteristics at the developing step" (col. 3, lines 42–51), answering this by incorporating into the powder an aliphatic carboxylic acid having at least 14, preferably at least 18, carbon atoms or a metal salt thereof. Miyakawa says that the acid or its salt "has a function to facilitate uniform dispersion of the magnetic material in the finely divided state and is effective for controlling charges of the developer (toner) particles to the negative side" (col. 5, lines 34–40).

Sitaramiah U.S. Pat. No. 4,430,408 discloses a monocomponent toner powder which is said to be less sensitive to changes in the size of the development gap and the doctor blade gap in magnetic brush systems, particularly in recording processes such as have been described in Nelson U.S. Pat. No. 4,121,931, Kotz U.S. Pat. No. 3,816,840 or Kotz U.S. Pat. No. 3,909,258. Sitaramiah accomplishes this by including in the toner powder a fluorine-modified alkyl siloxane and by attaching carbon black to the surface of the particles. Useful thermoplastic binders of the Sitaramiah patent include blends of wax component and a thermoplastic organic resin such as copolymers of styrene and one or more acrylate or methacrylate monomers. Useful wax components include aliphatic waxes such as amide hydroxy waxes, four of which are named at col. 4, lines 55–64.

Like Sitaramiah, most toner powders now on the market contain carbon black, sometimes embedded, sometimes at the surface, and sometimes both embedded and at the surface as in Noguchi et al. U.S. Pat. No. 4,189,390. While one function for the carbon black is to obtain an opaque image, Noguchi uses electrically conductive carbon black for its electrical properties, his toner powder being in the form of "essentially spherical members consisting essentially of plastics binder, magnetic particles and first electrically conductive particles dispersed therein, and second electrically conductive particles embedded on the spherical surface of the member" (col. 2, lines 7–15). Both the first and second electrically conductive particles could be carbon black.

SUMMARY OF THE INVENTION

The invention concerns a monocomponent toner powder which is highly triboelectric in nature in a surprisingly controlled fashion and yields extremely dense images at extraordinarily high speeds. In a preferred case, the resulting images are substantially better fixed to plain paper than are images obtained with commercially successful monocomponent toner powders.

Images formed with the novel monocomponent toner powder are as good in contrast as heretofore could be achieved by using 2-component toners while avoiding the shortcomings of 2-component toners. The monocomponent toner powder of the invention is also extraordinarily tolerant of variations in copying and non-impact printing processes, including variations in fusing temperatures and the sizes of the development gap. The novel toner powder has a range of desirable fusing temperature and is preferably also forgiving of environmental changes such as changes in relative humidity.

While leading monocomponent toner powders now on the market do not become significantly electrostatically charged until exposed to an electrical potential, as in an inductive process, the novel toner powder is intrinsically triboelectric. Thus, it becomes charged positively merely upon coming in contact with the metallic development roller and the charging tendency is substantially enhanced due to the agitation experienced by the toner powder on the development roller. The presence of a surprisingly large and unexpectedly well-controlled inherent triboelectric charge on the monocomponent is believed to permit imaging at extraordinarily high speeds. Also, the strong preference of the novel toner to charge positively fills another commercial need. While it can be used for forward imaging with negatively-charging photoconductors, most common commercial photoconductors, such as selenium or arsenic triselenide, used for non-impact printing or copying tend to be positively-charging. As such, the novel toner powder can be effectively used for reversal imaging (providing many advantages of reversal imaging discussed above) in many commercial non-impact printers.

Since the novel toner powder gives high image densities at relatively low photoconductor voltages, it can substantially enhance the photoconductor life, which can be a significant advantage as well.

In accordance with the present invention there is provided a monocomponent toner powder which comprises a plurality of discrete particles, each of which comprises a mixture of magnetically responsive material and a thermoplastic binder. The thermoplastic binder comprises a mixture of (a) one or more copolymers of styrene with at least one acrylate or methacrylate monomer, and (b) from 0.5 to 20% by weight of an amine-containing aliphatic wax which acts as a charge control agent. Although other thermoplastic resins can be used in combination with the styreneacrylate copolymer, the latter constitutes a major proportion of any such combination.

DETAILED DESCRIPTION

Figure 1:
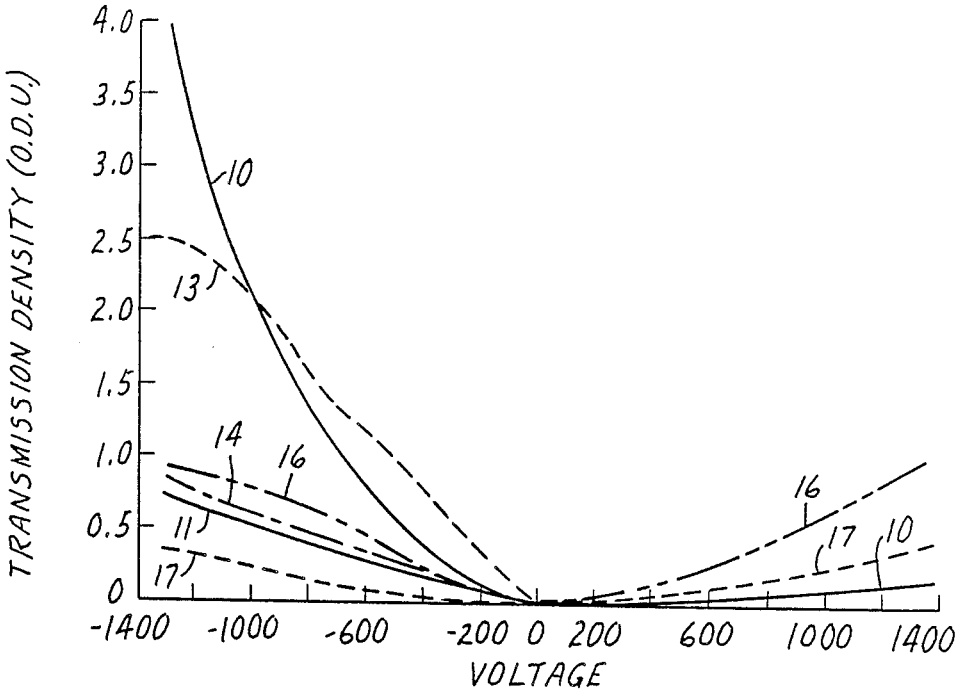
FIG. 1 shows the transmission (optical) density of the developed toner layer versus the applied surface potential at two different development speeds for the triboelectric monocomponent toner powder of the present invention and a prior art toner.

The styrene-containing copolymer should have a glass-transition temperature (T") from 45° to 75° C. At a $T_g$ above 75° C., the novel monocomponent toner powder might not flow, adhere to paper, or fuse well enough at acceptably low fusing temperatures, while at a $T_g$ below 45° C., the toner powder might not be sufficiently free flowing and might cause blocking under some environmental conditions. Any combination of styrene and at least one of acrylate and methacrylate monomers which provides a $T_g$ within that preferred range should provide a useful copolymer.

The acrylate and methacrylate monomers useful in the invention preferably are selected from lower alkyl acrylates and methacrylates wherein the alkyl group contains from 1 to 12 carbon atoms. These alkyl groups may be straight or branched chain groups.

Examples of styrene-containing copolymers useful in the invention include the Ionac TM series of materials commercially available from Sybron Chemicals. Specific examples of these materials include Ionac TM X-211 which is understood to be a copolymer of 58 parts styrene and 42 parts methylmethacrylate; Ionac TM X-231 which is understood to be a copolymer of 65 parts styrene and 35 parts n-butylmethacrylate. Another useful styrene-containing monomer comprises the copolymer of 75 to 90 parts styrene and 25 to 100 parts isooctylacrylate. Such copolymers may be made by techniques known in the art such as are described in *Polymerization Processes*, Edited by C. E. Schildknecht and I. Skeist, John Wiley and Sons, Inc., 1977.

The amine-containing aliphatic wax should have a hydrocarbon chain of at least 12 carbon atoms. Otherwise it might unduly soften the thermoplastic binder. Preferably the chain has at least 18 carbon atoms. A preferred aminecontaining aliphatic wax which is commercially available is a $C_{18}$ aliphatic wax having a secondary amine group, namely, "Armeen" 2HT from the Armak Company, and understood to have the formula $(C_{18}H)_2NH$. The amine-containing aliphatic wax can be adducted with an acrylate such as fluoro-octyl-sulfonyl-ethyl acrylate or isooctyl acrylate. While the amine-termination of the aliphatic wax preferably is a secondary amine, tertiary and primary amine termination should also be useful.

Preferably the amine-containing aliphatic wax comprises from 1 to 10 percent by weight of the novel toner powder. Concentrations below about 1% might result in a toner having relatively poor charging, while concentrations above about 10% might result in a toner which is too soft. About 2–5% of the amine-containing wax is preferred.

The novel toner powder contains a magnetically responsive material, preferably from 30 to 70% by weight, in order to facilitate the development of the toner powder on to the photoconductor drum under an electric field and its subsequent transfer on to paper.

The novel toner powder also preferably includes non-conductive (resistively $>10^{12}$ ohm-cm, preferably about $10^{15}$ ohm-cm) carbon black when black images are desired. As in the prior art, the carbon black may be dispersed throughout the toner particles, embedded at the surface of the particles or both dispersed throughout and embedded at the surface In order not to interfere with the triboelectric charging, any carbon black at the surface should be electrically nonconductive, i.e., have a resistivity of more than 10 ohm-cm, preferably about $10^{15}$ ohm-cm.

The toner powder of the invention may also contain other materials that are commonly used in the art, e.g., hydrophobic silica to facilitate flow.

The following examples illustrate the preparation of preferred triboelectric monocomponent toner powders of the invention. In the examples, all parts are by weight.

EXAMPLE 1

| | |
|---|---|
| Magnetite powder (Citco) | 60 parts |
| Copolymer of 58 parts of styrene and 42 parts n-butylmethacrylate (Ionac TM X-211 from Sybron Chemicals) | 36 |
| Amine-containing aliphatic wax (Armeen TM 2HT) | 4 |
| Resistive carbon black powder (Raven TM 5750 from Columbia Chemicals) | 2 |

The aliphatic wax, which is understood to have the formula $(C_{18}H_{37})NH$, was melt-blended into part of the copolymeric base resin, and the blend was hammer-milled to produce a dry blend that passed 20-mesh screen. The remaining base resin was dry-blended with the magnetite and the carbon black powder in a twin-shell blender at room temperature for 2 hours. These two dry blends were mixed in a 30-mm twin-screw co-rotating melt-mixer with the heaters set at temperatures in the range of 120°-150° C. The mixture was flaked on a nipping chill roll directly from the melt mixer. The flakes were hammer-milled to pass 20-mesh screen and then ground to micrometer dimensions in an air-jet mill. The resulting powder was air-classified to particle sizes from 8 to 20 micrometers. To improve the flow characteristics, the powder of the invention was surface-blended with 0.1 weight percent of hydrophobic silica powder ("Aerosil" R-972) for 1 hour at room temperature in a twin shell blender.

EXAMPLE 2

| | |
|---|---|
| Magnetite powder (Citco) | 60 parts |
| "Ionac" X-211 | 36 |
| Amine-containing aliphatic wax adduct | 4 |
| Resistive carbon black powder ("Raven" 5750) | 2 |

The amine-containing aliphatic wax adduct was made using a 1-liter, 3-neck flask equipped with heating mantle, mechanical stirrer, and thermometer. Weighed into the flask were 260 g of the amine-containing aliphatic wax of Example 1 and 300 g of a fluoro-octyl-sulfonyl-ethyl acrylate. Upon heating to 60° C., the mixture became stirrable. Additional heating to 120° C. while stirring resulted in a completely melted and clear mixture. This was allowed to react at 120-130° C. for 30 minutes, cooled to 110° C., and then poured into a pan where it cooled to a hard, brittle solid at room temperature.

Reaction:

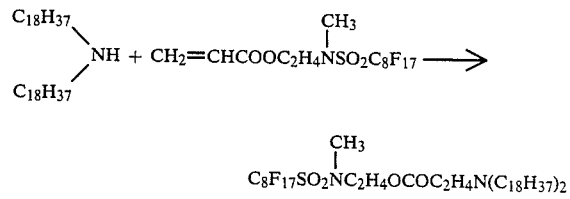

This adduct was used in the same way as was the aliphatic wax of Example 1 to make a monocomponent toner powder of the invention.

TESTING

Figure 2:
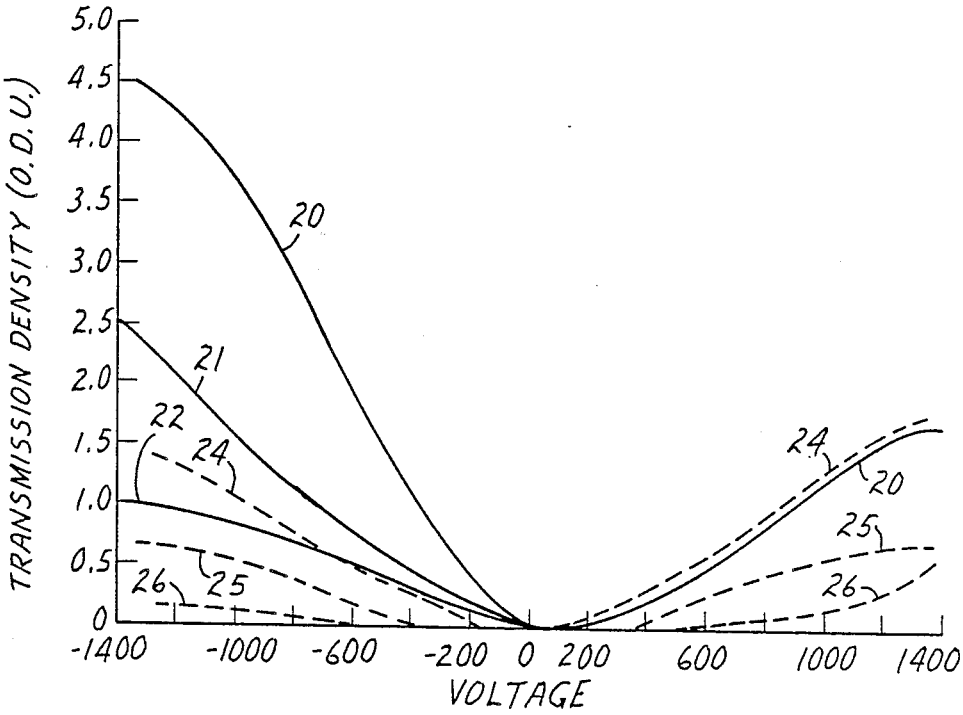
FIG. 2 shows the optical transmission density of the developed toner layer versus the applied surface potential at varying development gaps for the toner powders used to generate the data for FIG. 1.

Data used to make FIGS. 1 and 2 of the drawing were obtained using the experimental test rig of FIG. 1 of Bhateja et al., "On the Development Behavior of Resistive Monocomponent Toners", *Image Technology*, 1985/*SPSE* 38th *Annual Conference* published by Society of Photographic Scientists and Engineers, Springfield, VA, pages 175-179. Data shown in FIGS. 3-5 of the drawing refer to the fusing or fixing quality, i.e., how well the toner powder particles in the imaged area are fused to each other or to the paper surface. These data were obtained by first generating the needed unfused images on plain paper using the novel monocomponent toners of the present invention and a 3M "Secretary" III copying machine operating in the reversal imaging mode (but with its normal heat-fuser disabled). In order to obtain some information about the useful fusing temperature window exhibited by the different toners, the above unfused images were then fused in a versatile test rig by varying only the fusing temperature over a wide range (130°-220°), keeping everything else constant. A silicone hot fuser roll was employed for generating all the fused images for the present work. The fusing test rig employed has been described in A. C. Button and R. C. Edberg, "Hot roll fusing of monocomponent toners", The 2nd International Congress on Advances in Non-Impact Printing Technologies, Arlington, VA, Nov. 4-8, 1984, p. 202.

The fusing quality was then evaluated by two different tests: (a) The Crockmeter Test, which is a ruboff or abrasion test and, (b) The Tape-Adhesion Test which measures the levels of adhesion at the toner-paper interface.

The "Crockmeter Test" involves mounting a fresh white piece of cotton fabric on the underside of the plastic plug which is effectively under a constant load, resting it on the image/print to be tested and abrading the image by running the Crockmeter for five cycles. The McBeth reflectance density of the Crockmeter-tested patches of cloth is a measure of the toner abraded away from the image and is referred to as the Crockmeter Number (CN). Thus, the lower the value of CN, the better the fusing quality. Further details on the Crockmeter test can be found in the following references:

1 S. K. Bhateja and J. R. Gilbert, Journal of Imaging Technology, II, 271 (1985)

2. S. K. Bhateja and J. R. Gilbert, Journal of Imaging

Technology, II, 278 (1985) 3. S. B. Collins, A. C. Button and R.H. Helland,

"Fusing of Single-Component Toners", 4th International Conference on Electrophotography, Washington, D.C., Nov. 1981, p. 179

The tape-adhesion test, described in detail in references 2 and 3 above, involves laying a Scotch brand tape (#810) onto the image to be tested under uniform pressure and peeling it off the image at 180° at a constant speed. The reflectance density of the tested images is a measure of the level of adhesion at the toner-paper interface; the higher numbers indicate better fixing. 1he units reported are optical density units (O.D.U.).

Used as a "control" in the testing was a commercially available monocomponent toner which is believed to yield prints at least equal in overall image quality to that of those obtained from any other monocomponent toner powder now on the market for use in a "Secretary" III copier. It is below called "Prior Powder A".

In FIG. 1, transmission image densities were measured from images made using the toner powders of Example 1 and 2 in comparison to Prior Powder A at each of the two different development speeds, namely, at 24 cm/sec and 160 cm/sec. Many commercial copiers and non-impact printers operate at about 20–30 cm/sec, but the data of FIG. 1 with toner powders of Examples 1 and 2 demonstrate feasibility of operation at development speeds as high as 160 cm/sec.

In FIG. 1;

Curves 10 and 11 indicate transmission densities attained using the toner powder of Example 1 at development speeds of 24 and 160 cm/sec., respectively;

Curves 13 and 14 indicate transmission densities attained using the toner powder of Example 2, at development speeds of 24 and 160 cm/sec., respectively, and except that curves 11, 13 and 14 are not shown at the right side of FIG. 1, because their right-side portions substantially duplicate that of curve 10. Curves 16 and 17 indicate transmission densities attained using Prior Powder A at development speeds of 24 and 160 cm/sec., respectively.

It can be seen from FIG. 1 that the tone: powders of the invention inherently charge strongly positively due to some triboelectric mechanism, i.e., due to contact with the metallic development roller By comparison, the Prior Powder A tends to be neutral, i.e., it has no preference for charging positively or negatively (see FIG. 1). This is typical of the monocomponent toners of the prior art which, therefore, tend to operate by the induction process, i.e., they tend to charge only when under an electric potential. But, surprisingly the monocomponent toner powders of the invention exhibit a large and well-controlled inherent charge, despite the small surface area of contact that monocomponent toners typically have with the development roller. The strong preference of the toner powder of the invention to charge positively and the accompanying high image densities make them very attractive for reversal imaging in non-impact printers that utilize a positive charging photoconductor (such as selenium). And, most of the positive photoconductors employed in commercial non-impact printers are positively charging.

It can also be seen from FIG. 1 that at a development speed of 24 cm/sec—a speed currently employed in some commercial copiers—exceedingly dense images can be obtained using each of the toner powders of Examples 1 and 2. Table I shows the ratio $\alpha$ of the transmission density of the developed toner layer using toner powder of either Example 1 or Example 2 to the transmission density of the developed toner layer obtained using the Prior Powder A, at varying development voltages and each of the two development speeds chosen for illustration. It can be seen that the ratio $\alpha$ varies anywhere from 2.09 to $>10$, depending upon the development voltage and the development speed. FIG. 1, curves 11 and 14, shows that at a development speed just a little slower than 160 cm/sec, each of the monocomponent toners of Examples 1 and 2 would provide images substantially equal in transmission density to those obtained at only 24 cm/sec using Prior Powder A (Curve 16). This offers a major advantage for the toner powders of the invention over the Prior Powder A (or the prior art) because they will permit operation at the commercially attractive high speeds. The toner powders of the invention offer another major advantage in terms of enhanced photoconductor life. In view of the extremely dense images obtained with the toner powders of the invention, they will permit operation at relatively low photoconductor voltages resulting in much enhanced photoconductor life.

TABLE I

| Development Voltage (V) | Ratio $\alpha$ 24 cm/sec for toner powder of Example 1 | Example 2 | 160 cm/sec for toner powder of Example 1 | Example 2 |
|---|---|---|---|---|
| −1,300 | 4.43 | 2.87 | 2.09 | 2.34 |
| −1,000 | 2.53 | 2.70 | 2.39 | 2.74 |
| −750 | 2.37 | 2.29 | 5.71 | 7.0 |
| −500 | 2.97 | 2.97 | 7.5 | 7.0 |
| −200 | 10.0 | 9.50 | >10 | >10 |

In FIG. 2, Curves 20, 21 and 22 show transmission densities of images obtained at various voltages using the toner powder of Example 1 at a development speed of 24 cm/sec and development gaps of 0.25, 0.75 and 1.5 mm, respectively. Curves 24, 25 and 26. show transmission densities of images obtained using Prior Powder A under the same conditions, also at development gaps of 0.25, 0.75 and 1.5 mm, respectively. Curves 21 and 22 are not shown at the right side of FIG. 2 because at all positive voltages the image densities are very low (less than 0.2 O.D.U.) and so that the other curves can be seen more clearly. As has been pointed out, the toners of the invention charge strongly positively.

Curve 21 in comparison to curve 24 shows the extraordinary tolerance of the toner powder of Example 1 to large development gap variations. It is surprising that even at a development gap three times as large as that used with the Prior Powder A to obtain curve 24, the toner powder of the invention would provide denser images. This means that using the toner powders of the invention, the development gap will not have to be set or controlled very closely. This kind of gap or machine latitude is extremely desirable in non-impact printing or copying machines.

Figure 3:
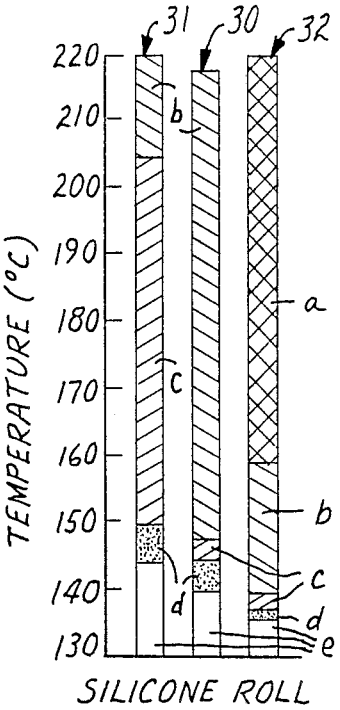
FIG. 3 is a bar graph showing the comparative fusing quality in terms of resistance to rub-off of prints made from the toner powders of the invention and the prior art toner.
Figure 4:
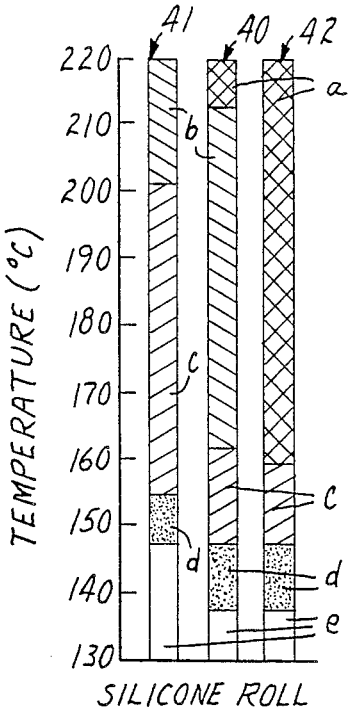
FIG. 4 is a bar graph showing the comparative fusing quality in terms of resistance to rub-off of prints like those tested in FIG. 3 except being gray instead of black, the toner powders being the same as those used to obtain FIG. 3.
Figure 5:
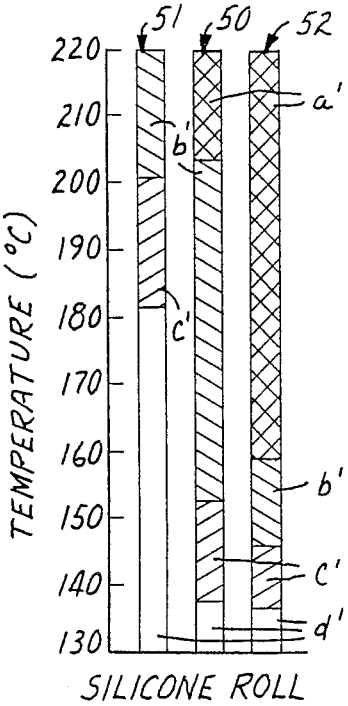
FIG. 5 is a bar graph showing the comparative fusing quality in terms of the level of adhesion at the toner-paper interface, i.e., in terms of the resistance of the fused toner layer to being removed by pressure-sensitive adhesive tape, the tested toner powders being the same as those used to obtain FIG. 33.

FIGS. 3 to 5 demonstrate the tolerance of images made on plain paper using the tested toner powders to fusing temperature variations which inevitably occur in non-impact printers and copiers.

In FIG. 3, bars 30, 31 and 32 show the resistance to rub-off, as measured by the Crockmeter Test, of black images made at varying fusing temperatures using the toner powders of Example 1, Example 2, and Prior Powder A, respectively.

In FIG. 4, bars 40, 41 and 42 show the resistance to rub-off, as measured by the Crockmeter Test, of grey images made at varying fusing temperatures using the toner powders of Example 1, Example 2 and Prior Powder A, respectively.

In FIGS. 3 and 4, the various different areas on the bars indicated as a, b, c, d and e represent the following:

Areas a hot offset, i.e., some toner adheres to the Silicone fuser roll which subsequently shows up as a ghost-image on the next print Areas b=excellent fusing quality, i.e., CN<0.20 O.D.U.

Areas c=good fusing quality, i.e, CN=0.20-0.30 O.D.U.

Areas d=fair fusing quality, i.e., CN=0.30-0.40 O.D.U.

Areas e=poor fusing quality, i.e., CN>0.40 O.D.U.

In FIG. 5, bars 50, 51, and 52 show the level of toner-paper adhesion, as measured by the tape test O.D.U., of black images made at varying fusing temperatures using the toner powders of Example 1, Example 2 and Prior Powder A, respectively. The various different areas on the three bars indicate:

Areas a'=hot offset

Areas b'=excellent fusing quality (tape test O.D.U. >1.0)

Areas c'=good fusing quality (tape test O.D.U.=0.-40-1.0)

Areas d'=poor fusing quality (tape test O.D.U. <0.40)

As can be seen from FIGS. 3, 4 and 5, toner powders of Examples 1 and 2 are "compatible" with the silicone fuser rollers over a desirable and a wide range of fusing temperatures, i.e., over a wide temperature range during the fusing process, no toner particles from the imaged area transfer on to, and adhere to, the fuser roll; compatibility with the fuser roll is a feature that a toner must exhibit to be usable, otherwise ghost images can appear on subsequent prints. Comparing FIGS. 3, 4 and 5, it becomes clear that toner powders of Examples 1 and 2 provide a much wider fusing temperature window than does Prior Powder A, considering the rub-off resistance in black and grey prints (FIGS. 3 and 4) as well as the toner-paper bond (FIG. 5). In fact, toner powder of Example 1 provides an exceptionally broad fusing temperature window. Fusing temperature, thus, adds another parameter to the forgiving nature of the toner powders of the invention pointed out earlier, for instance, in terms of tolerance to the variations of the development gap, development speed or photoconductor voltage. Such an extreme tolerance on the part of a toner powder in setting the machine parameters, i.e., a wide machine latitude offers a major advantage in terms of its commercial use or applications.

EXAMPLE 3

The toner powder of this Example was made in the same way as that of Example 2 except that the starting ingredients were as follows:

| | |
|---|---|
| Magnetite powder (Citco) | 60 parts |
| "Ionac" X-231 | 36 |
| Amine-containing aliphatic wax adduct | 4 |
| Resistive carbon black powder ("Raven" 5750) | 2 |

"Ionac TM X-231 is understood to be a copolymer of 5 parts of styrene and 35 parts of n-butylmethacrylate.

The above adduct was made from 521 parts of $(C_{18}H_{37})$:NH and 186 parts of isooctyl acrylate by the same procedure as in Example 2.

The resulting toner powder was tested for transmission image density in the same manner as were the toners of Examples 1 and 2. The doctor blade gap was 0.46mm, the development gap was 0.5mm, and the developer shell rotated at 350rpm (development speed of 24 cm/sec). The transmission densities obtained are set out in Table II.

TABLE II

| Voltage | Transmission Density (O.D.U.) |
|---|---|
| −1300 | 1.12 |
| −1000 | 0.78 |
| −850 | 0.49 |
| −700 | 0.38 |
| −200 | — |
| 200 | 0.03 |
| 500 | 0.04 |
| 800 | 0.04 |
| 1000 | 0.06 |
| 1300 | 0.27 |

The data indicate that the toner charged inherently strongly positive.

EXAMPLE 4

A styrene-isooctyl acrylate copolymer was made using a 2-liter split flask equipped with an agitator, a condenser; a nitrogen purge and a temperature control. Weighed into the flask were 8g $Ca_3(PO_4)_2$, 0.1 g of 1% by weight sodium lauryl sulfate in water, and 800g of deionized water. The ingredients were heated to 70° C. with agitation under a nitrogen purge until all of the $Ca_3(PO_4)_2$, was dispersed. A premix consisting of 350g of styrene, 50g of isooctylacrylate, 0.1 g of isooctyl thioglycolate and 2g of AZO-bis-isobutyronitrile was prepared and then added to the flask. The temperature control was set to 70° C. and the ingredients allowed to react for 16 hours under nitrogen purge. No runaway exotherm was observed. Unreacted monomer was distilled off by shutting off the cooling condenser, increasing the heat input to the flask and purging with nitrogen for 4 hours. The resulting hot dispersion of polymer beads was filtered through two layers of cheesecloth, and the beads washed with four 5-liter tap water charges followed by two 3-liter deionized water charges. The beads were then spread on a release-coated paper and dried for two days at 65° C. Gel permeation chromatography was used to determine the weight average molecular weight (356,432) and number average molecular weight (103,529) of the polymer. Differential scanning calorimetry was used to determine the glass transition temperature of the polymer (62.8° C.).

A toner powder was then made in the same way as that of Example 1 except that the starting ingredients were:

| | |
|---|---|
| Magnetite powder (Citco) | 60 parts |
| Copolymer of styrene and of isooctyl acrylate | 36 |
| Armeen TM 2HT | 4 |
| Raven TM 5750 Carbon black | 2 |

The resulting toner powder was tested for transmission image density in the same manner as were the toners of Examples 1 and 2. The doctor blade gap was 0.46mm, the development gap was 0.5mm, and the developer shell rotated at 350 rpm (development speed of 24 cm/sec). The transmission densities obtained are set out in Table III.

TABLE III

| Voltage | Transmission Density (O.D.U.) |
|---|---|
| −1300 | 1.7 |
| −1000 | 1.05 |
| −750 | 0.65 |
| −500 | 0.15 |
| −200 | 0.02 |
| 200 | 0.02 |
| 500 | 0.02 |
| 750 | 0.02 |
| 1000 | 0.05 |
| 1300 | 0.7 |

The data indicate that the toner charged inherently strongly positive.

EXAMPLE 5

The toner powder of this Example was made in the same way as that of Example 2 except that the starting ingredients were:

| | |
|---|---|
| Magnetite powder (Citco) | 60 parts |
| Styrene/Isooctylacrylate Polymer of Example 4 | 36 |
| Amine-containing aliphatic wax adduct of Example 2 | 4 |
| Raven TM 5750 Carbon Black | 2 |

The resulting toner powder was tested for transmission image density in the same manner as were the toners of Examples 1 and 2. The doctor blade gap was 0.46mm, the development gap was 0.5mm, and the developer shell rotated at 350 rpm (development speed of 24 cm/sec). The transmission densities obtained are set out in Table IV.

TABLE IV

| Voltage | Transmission Density (O.D.U.) |
|---|---|
| −1300 | 1.65 |
| −1000 | 1.02 |
| −750 | 0.65 |
| −500 | 0.25 |
| −200 | 0.04 |
| 200 | 0.02 |
| 500 | 0.02 |
| 750 | 0.11 |
| 1000 | 0.22 |
| 1300 | 0.6 |

The data indicate that the toner charged inherently strongly positive.

What is claimed is:

1. Monocomponent toner powder comprising a plurality of discrete particles, each a mixture of (1) a thermoplastic binder comprising at least one copolymer of styrene having a glass-transition temperature ranging from about 45° to about 75° C. and at least one of acrylate and methacrylate monomers and (2) magnetically responsive material, wherein the improvement comprises:

from 0.5 to 20 percent by weight of the thermoplastic binder is amine-containing aliphatic wax having a secondary amine group adducted with an acrylate, said amine-containing aliphatic wax having two carbon chains of at least 12 carbon atoms each.

2. Monocomponent toner powder as defined in claim 1 wherein the amine-containing aliphatic wax comprises from 1 to 10 percent by weight of the particle.

3. Monocomponent toner powder as defined in claim 2 wherein the aminecontaining aliphatic wax has two carbon chains of at least 18 carbon atoms each.

4. Monocomponent toner powder as defined in claim 3 wherein the amine-containing aliphatic wax has the formula

5. Monocomponent toner powder as defined in claim I wherein the acrylate is a fluoro-alkyl-sulfonyl-alkyl acrylate.

6. Monocomponent toner powder as defined in claim 1 wherein the acrylate is an octyl-acrylate.

7. Monocomponent toner powder as defined in claim 1 and containing a pigment.

8. Monocomponent toner powder as defined in claim 7 wherein the pigment comprises carbon black.

9. Monocomponent toner powder which inherently charges positively triboelectrically and comprises a plurality of discrete particles, each comprising a mixture of by weight (1) from 30 to 70 percent of a thermoplastic binder and (2) from 30 to 70 percent of magnetically responsive material, the thermoplastic binder comprising (a) from 70 to 99.5 percent of at least one copolymer of styrene having a glass-transition temperature ranging from about 45° to about 75° C. and a monomer selected from at least one of acrylate amd methacrylate monomers, and (b) from 0.5 to 20 percent of an amine-containing aliphatic wax having a secondary amine group adducted with an acrylate, said amine-containing aliphatic wax having two carbon chains of at least 12 carbon atoms

10. Monocomponent toner powder as defined in claim 9 wherein the amine-containing aliphatic wax has the formula $(C_{18}H_{37})_2NH$.

* * * * *

UNITED STATES PATENT AND TRADEMARK OFFICE

CERTIFICATE OF CORRECTION

PATENT NO. : 4,833,056

DATED : MAY 23, 1989

INVENTOR(S) : S. K. BHATEJA, C. I. YOUNG, N. N. QUAN

It is certified that error appears in the above-identified patent and that said Letters Patent is hereby corrected as shown below:

Col. 1, line 35, "electrophtography" should be

— electrophotography --.

Col. 4, line 13, "33" should be -- 3 --.

Col. 4, line 17, "(T")" should be — (Tg) --.

Col. 5, line 36 "$(C_{18}H_{37})NH$" should be -- $(C_{18}H_{37})_2NH$ --.

Col. 7, line 12 "lhe" should be — The --.

Col. 7, line 38 "Curves" should not be in bold print and should begin a new paragraph.

Col. 7, line 42 "tone:" should be -- toner --.

Col. 9, line 8 "a hot" should be — a = hot --.

Col. 9, line 68 "5" should be -- 65 --.

Col. 10, line 2 "$(C_{18}H_{37})$:NH" should be -- $(C_{18}H_{37})_2NH$ --.

Col. 12, line 25 after "formula" add — $(C_{18}H_{37})_2NH$ --.

UNITED STATES PATENT AND TRADEMARK OFFICE

CERTIFICATE OF CORRECTION

PATENT NO. : 4,833,056

DATED : May 23, 1989

INVENTOR(S) : S. K. Bhateja, et al

It is certified that error appears in the above-identified patent and that said Letters Patent is hereby corrected as shown below:

Column 12, line 27, "I" should be -- 1 --.

Signed and Sealed this

Twenty-seventh Day of March, 1990

*Attest:*

JEFFREY M. SAMUELS

*Attesting Officer*

*Acting Commissioner of Patents and Trademarks*